United States Patent [19]

Quarve

[11] 4,378,201

[45] Mar. 29, 1983

[54] DIAPHRAGM PUMP HAVING SPOOL AND GUIDE MEMBERS

[75] Inventor: Vernon K. Quarve, Minneapolis, Minn.

[73] Assignee: Graco Inc., Minneapolis, Minn.

[21] Appl. No.: 208,175

[22] Filed: Nov. 19, 1980

[51] Int. Cl.[3] ..... F04B 43/06

[52] U.S. Cl. ..... 417/388; 417/383; 417/395

[58] Field of Search ..... 417/383, 385, 387, 388, 417/389, 395; 92/99, 100

[56] References Cited

U.S. PATENT DOCUMENTS

| | | | |
|---|---|---|---|
| 3,075,468 | 1/1963 | Eifel | 417/388 |
| 3,779,669 | 12/1973 | Sommer | 417/387 X |
| 3,925,988 | 12/1975 | Kelley | 417/385 X |
| 3,957,399 | 5/1976 | Siczek | 417/387 |
| 4,022,381 | 5/1977 | Karliner | 417/388 X |

FOREIGN PATENT DOCUMENTS

| | | |
|---|---|---|
| 719619 | 12/1954 | United Kingdom . |
| 1208003 | 10/1970 | United Kingdom . |
| 1465123 | 2/1977 | United Kingdom . |

*Primary Examiner*—Leonard E. Smith
*Attorney, Agent, or Firm*—Paul L. Sjoquist

[57] ABSTRACT

An improved hydraulic pump wherein a piston is mechanically reciprocated by a suitable drive in an oil chamber, and a second piston is caused to reciprocate by the oil pressure developed in the chamber, the second piston also reciprocating in a pumping chamber to cause the pumping of a liquid through the pumping chamber; a diaphragm attached to the second piston provides liquid isolation between the oil chamber and the pumping chamber.

9 Claims, 6 Drawing Figures

DIAPHRAGM PUMP HAVING SPOOL AND GUIDE MEMBERS

BACKGROUND OF THE INVENTION

This invention relates to an improved hydraulic pump, and more particularly to a pump for pumping liquids at pressures up to approximately 3,000 pounds per square inch (psi) by using a combination of mechanical piston reciprocation and hydraulic forces.

In the field relating to pumps for pumping liquids at high pressure and low volumes, it is common to utilize pumps having a relatively small-sized piston, on the order of ½–2 inches in diameter, with a very short stroke, less than 1 inch, and to reciprocate the piston at a very high rate of speed, in the range of 1000–3000 revolutions per minute (RPM). Pumps of this general type develop their high pumping flows by the high rate of reciprocation of the piston, rather than through combinations of large piston surface area and driving forces. Pumps of this general class utilize a pumping chamber having spring-loaded inlet and outlet vales, where liquid is drawn into the pumping chamber during the piston suction stroke by the pressure differential across an inlet valve and is pumped out of the pumping chamber during the compression stroke of the piston by the pressure differential across the outlet valve. The pressure differentials required to open the inlet and outlet valves in the pumping chamber are determined by the respective springs selected to hold the inlet and outlet valves in their closed positions. Such pumps can typically pump liquids at the rate of 0.2–3 gallons per minute, and are to be distinguished from other types of pumps which are utilized at considerably higher flow rates.

It is also known to develop so-called diaphragm pumps which utilize a diaphragm membrane in liquid isolation between a pumping chamber and an oil-filled chamber. These pumps typically operate by inducing, through one means or another, a pressure reciprocation in the oil chamber which causes the diaphragm to reciprocate in coincidence and thereby creates in the pumping chamber the necessary liquid pressure fluctuations for drawing liquid into the pumping chamber and forcing liquid out of the pumping chamber. Such diaphragm pumps have been constructed with mechanically reciprocating devices coupled to the diaphragm, or with mechanically reciprocating pistons coupled to the oil chamber for developing the necessary pressure forces for moving the diaphragm. It is not unusual to utilize springs in conjunction with such pumps to cause the diaphragm membrane to seat in a "rest" position, and to utilize the oil pressure developed within the oil chamber to move the diaphragm from the "rest" position.

In all such pumps it is necessary to provide valves to ensure pressure and volume control in the oil chamber and in the pumping chamber under all pumping conditions. For example, the condition where the output liquid line becomes shut off or blocked, some means must be provided for relieving the internal pressures so as to discontinue the pumping reciprocation pressure forces at some predetermined pressure level. Pressure sensors have been used to monitor output pump pressures and to shut off the reciprocating mechanism whenever output pressure reaches a certain predetermined level. Internal valving has been developed to bypass either the fluid in the pumping chamber or the oil in the oil chamber under these conditions, whereby the reciprocation mechanism continues operating but does not continue to develop high pressures. Depending upon particular applications, any of these pressure control mechanisms may be useful in a particular pump. For example, a water pump may utilize a recirculating bypass mechanism coupled into the pumping chamber for recirculating water through the pumping chamber whenever downstream pressure reaches a predetermined level. A paint pump, on the other hand, may utilize an oil chamber recirculating mechanism to control the internal oil chamber pressure levels and thereby limit pumping pressure, to avoid continuously recirculating paint, which recirculation tends to break down the desired paint qualities.

The mechanism for driving a pump of the type described herein is typically an electric motor. The motor may be mechanically coupled to a pump crankshaft, and a reciprocable piston may be connected to the crankshaft, wherein the piston reciprocates within a cylinder filled with oil, and into a chamber also filled with oil. Reciprocation of the piston causes pressure fluctuations within the oil chamber in coincidence with the reciprocation, and these pressure fluctuations may be utilized to drive a diaphragm separating the oil chamber from a pumping chamber. The diaphragm isolates the oil from the pumping chamber but conveys the pressure fluctuations into the pumping chamber, thereby providing a suction and driving means for pumping liquid through the pumping chamber. A primary disadvantage with pumps of this general description is in the relative fragility of the diaphragm membrane separating the two chambers. Since the diaphragm is required to deflect at fairly high rates of speed it will invariably rupture at reasonably frequent intervals, and when a diaphragm rupture occurs the liquid being pumped becomes contaminated with the oil in the pump, and vice versa, usually requiring that the pump be dismantled and thoroughly cleaned. Depending upon the liquids being pumped, a diaphragm rupture may cause contamination to the point where the pump bearings or piston or other pump moving parts are damaged. Introduction of oil from the pump into the liquid being pumped will thoroughly contaminate the liquid which may result in costly or destructive effects in the pumped liquid flow path. For example, if this liquid is paint, oil contamination in the paint may result in the contamination of a significant quantity of paint both downstream and upstream of the pump.

Various devices have been developed to extend the life of a diaphragm in a diaphragm pump, for example, U.S. Pat. No. 4,050,859, issued Sept. 27, 1977, describes an apparatus for an improved diaphragm pump wherein hydraulic shock and mechanical wear to the diaphragm membrane is reduced by providing a circular reed valve member adjacent to the diaphragm. The reed valve member provides a barrier to pressurized hydraulic oil jets from direct impingement upon the diaphragm membrane, and also assists in reducing hydraulic shock effects on the diaphragm membrane.

SUMMARY OF THE INVENTION

The present invention provides an improvement in hydraulically operated pumps by utilizing a mechanically reciprocating piston to develop oil pressure fluctuations in an oil chamber, and by utilizing the oil pressure fluctuations to reciprocate a second free piston in fluid coupling to the oil chamber, and by providing liquid isolation between the oil chamber and a pumping chamber with a diaphragm attached to the second free piston. The pressure forces developed for pumping are primarily provided by the free piston in the oil chamber, and the diaphragm serves primarily as a liquid isolation membrane for separating the oil chamber from a pumping chamber. This construction yields the dual advantage of having a reliable reciprocating piston for pumping liquids, while obtaining liquid separation between the pumping chamber and oil chamber with a diaphragm membrane.

It is a primary object of the present invention to provide a hydraulically operated pump having reliable operating characteristics at high operating pressures while maintaining positive isolation between the hydraulic oil chamber and the liquid pumping chamber.

It is another object of the present invention to provide a hydraulically operated pump capable of operating at high pressure, with built-in relief valving for operating under predetermined pressure conditions.

It is another object of the present invention to provide a hydraulically operated pump having automatic oil chamber oil level controls, and pressure relief from excess pressure developing in the oil chamber.

It is a further object of the present invention to provide a hydraulically operated pump having a bypass valve coupled into the outlet line for regulating outlet pressure.

It is a further object of the present invention to provide a hydraulically operated pump having means for priming the pump, and for relieving pump output pressure under operator control.

BRIEF DESCRIPTION OF THE DRAWINGS

Other and further objects will become apparent from the appended specification, and with reference to the drawings, in which.

DESCRIPTION OF THE PREFERRED EMBODIMENT

Figure 1:
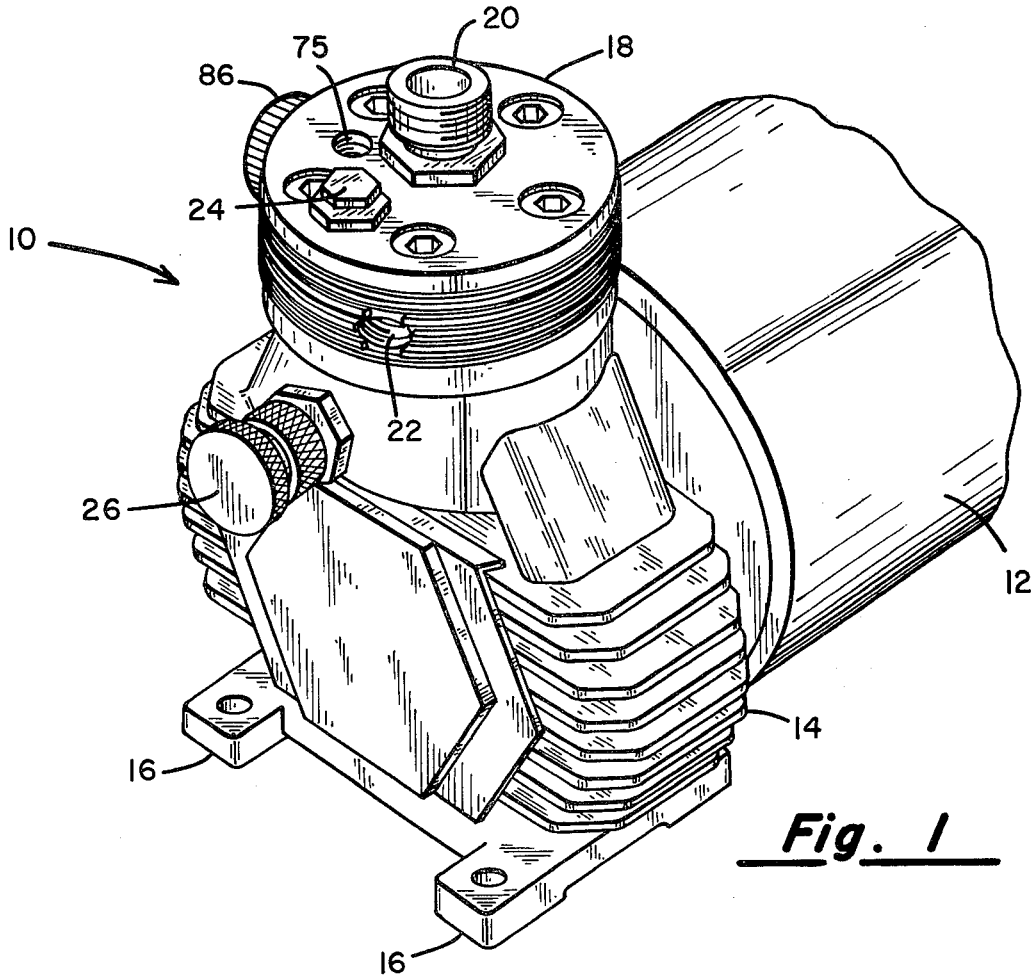
FIG. 1 is an isometric view of the invention.

Referring first to FIG. 1, there is shown a pump 10 which is the subject of the present invention, and a motor 12 coupled in driving relationship to pump 10. Motor 12 is preferably an electric motor in the rating range of 0.5–1.5 horsepower. Pump 10 has a casing 14 which is suitably designed with cooling fins for transferring heat developed in the oil system within the pump to the outside. Casing 14 has formed as a part thereof mounting feet 16 for attaching the apparatus to a suitable base for operation.

Pump 10 has a removable head 18 which is secured to casing 14 by means of a plurality of bolts. Head 18 has an inlet port 20 and an outlet port 22 for respectively receiving and pumping a liquid to be handled by the device. An outlet check valve 24 is threadably attached to head 18, and is in flow communication inside of head 18 with outlet port 22. A pressure adjustment valve 26 is threaded into and through casing 14, and functions in a manner which will be hereinafter described.

Figure 2:
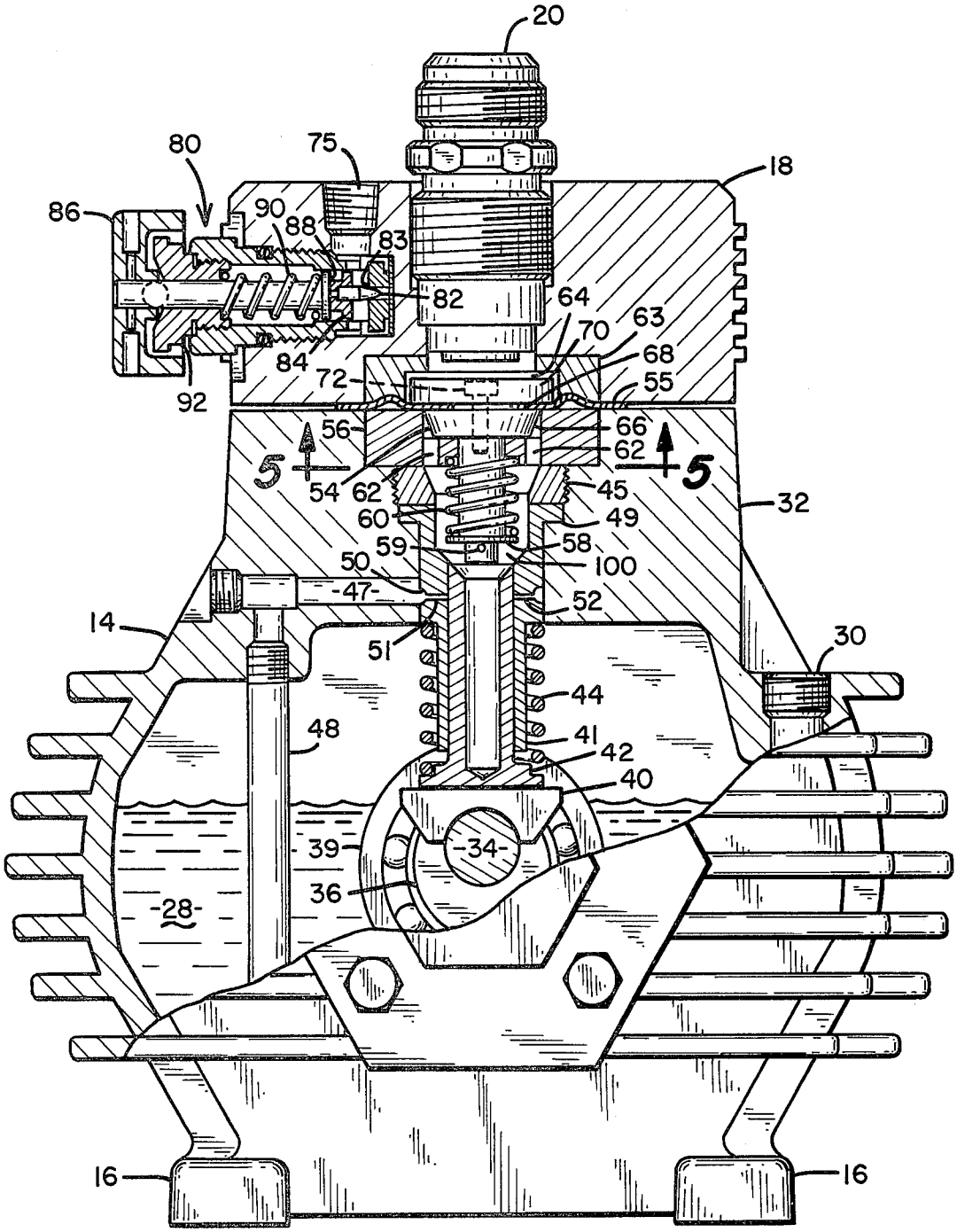
FIG. 2 is an elevation view in partial cross-section.

Referring next to FIG. 2, pump 10 is shown in elevation view and in partial cross-section. The lower interior of casing 14 forms an oil reservoir 28, which reservoir may be filled through threaded opening 30. The upper portion of casing 14 forms a heavy casting 32 for supporting head 18, and having suitable bore holes for accommodating the moving parts and flow paths of the invention.

Crank 34 forms a part of a shaft 36 which is mounted in bearings 38 and 39 seated in casing 14. A bearing shoe 40 partially encompasses crank 34, and a piston 42 slidably rides on bearing shoe 40. Piston 42 is held against bearing shoe 40 by means of compression spring 44, which is compressed between the underside of casting 32 and a shoulder on piston 42. The detailed structure and operation of the piston drive assembly is shown in U.S. Pat. No. 4,019,395, issued Apr. 26, 1977, and owned by the assignee of the present invention. For purposes of the present invention, the rotation of shaft 36 causes reciprocation of piston 42 within sleeve 41.

A tube 48 projects downwardly into oil reservoir 28 and is threadably attached to the casing 14 in flow communication with passage 47. Passage 47 is in flow communication with an annular groove 50 around sleeve 41. A pair of diametric passages 51, 52 are drilled from groove 50 to the inside surface of sleeve 41, and thereby provide an oil flow path to piston 42. This flow path becomes uncovered during each piston 42 operating cycle, when piston 42 is near the bottom of its stroke. Sleeve 41 has a circumferential raised shoulder 49 at one end, and casting 32 is bored to accept sleeve 41 and shoulder 49. A locking ring 45 is threaded to screw into complementary threads in casting 32, and to tighten shoulder 49 of sleeve 41 against casting 32.

A free piston, hereinafter referred to as spool 54, is slidably seated in a spool guide 56. Spool guide 56 is seated in a bore in casting 32. A collar 58 is attached to spool 54 by means of pin 59. A compression spring 60 is positioned between collar 58 and an annular recess on the underside of spool guide 56. Compression spring 60 urges spool 54 downwardly against the spool guide 56. Spool guide 56 has four holes 62 drilled through the top and bottom surfaces, providing for oil flow communication paths through spool guide 56.

Spool 54 has a tapered circumferential shoulder 66, wherein the full diameter of the top surface 68 of spool 54 is reduced to a smaller diameter on the lower surface of spool 54 contacting spool guide 56. Tapered shoulder 66 permits a substantially close dimensional tolerance between the diameter of top surface 68, and with respect to the bore hole in spool guide 56 while allowing oil flow communication in oil chamber 100 with tapered shoulder 66.

Diaphragm 55 is clamped between head 18 and casing 32. Diaphragm 55 is also clamped between the top surface 68 of spool 54 and the lower surface of spool head 70. A threaded fastener 72 secures spool head 70 against diaphragm 55, and is threadably tightened into spool 54. Fastener 72 fits in a recess in spool head 70 so as to not project above the top surface of spool head 70.

Spool head 70 reciprocates within a pumping chamber 64 made from a bore in insert 63. The bore in insert 63 is of greater diameter than the diameter of spool head 70 to provide free clearance for the reciprocation of spool head 70 within insert 63. The diameter of spool head 70 is preferably about 1.5 inches, and the maximum height of chamber 64 above the top surface of spool head 70 is approximately 0.070 inches.

Figure 3:
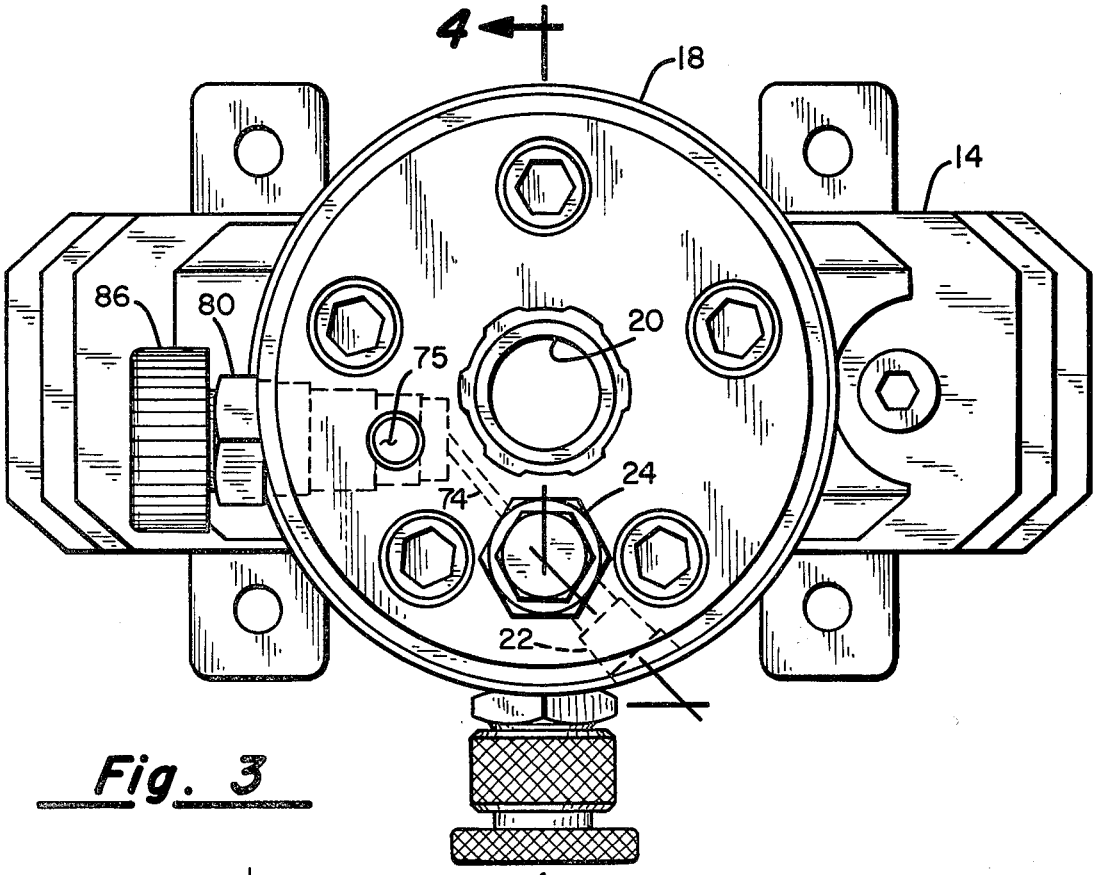
FIG. 3 is a top view of the invention.

Inlet port 20 opens into chamber 64 through a check valve (not shown), and outlet port 22 also opens into chamber 64 through a second check valve 24. FIG. 3 shows these ports in a top view of the invention. A bypass port 75 is also coupled to chamber 64 through passage 74. A bypass valve 80 is threaded into head 18 to control the liquid flow through bypass port 75.

Bypass valve 80 has a tapered needle 82 (FIG. 2) seated at shoulder 83 in a passage which is in fluid coupling relationship to passage 74. Needle 82 is mounted in a valve guide 84 which is attached to an adjustment knob 86. A shoulder 88 on valve guide 84 holds a compression spring 90 against the body of valve 80. Compression spring 90 urges needle 82 into a closure position against its seat 83. Valve guide 84 has a helical shoulder 92 which bears against the body of valve 80. Rotation of knob 86 causes helical shoulder 92 to bear against the valve body and thereby mechanically displace valve guide 84 and needle 82 from a nominally closed valve position. Therefore, rotation of knob 86 manually opens valve 80 to permit liquid flow between passage 74 and bypass port 75. When knob 76 is rotated so as to place the valve in its fully closed position needle 82 will be raised from its seat only upon becoming subject to a predetermined internal pressure. The amount of pressure required to raise needle 82 from its seat is dependent upon and predetermined by the selection of compression spring 90.

Figure 4:
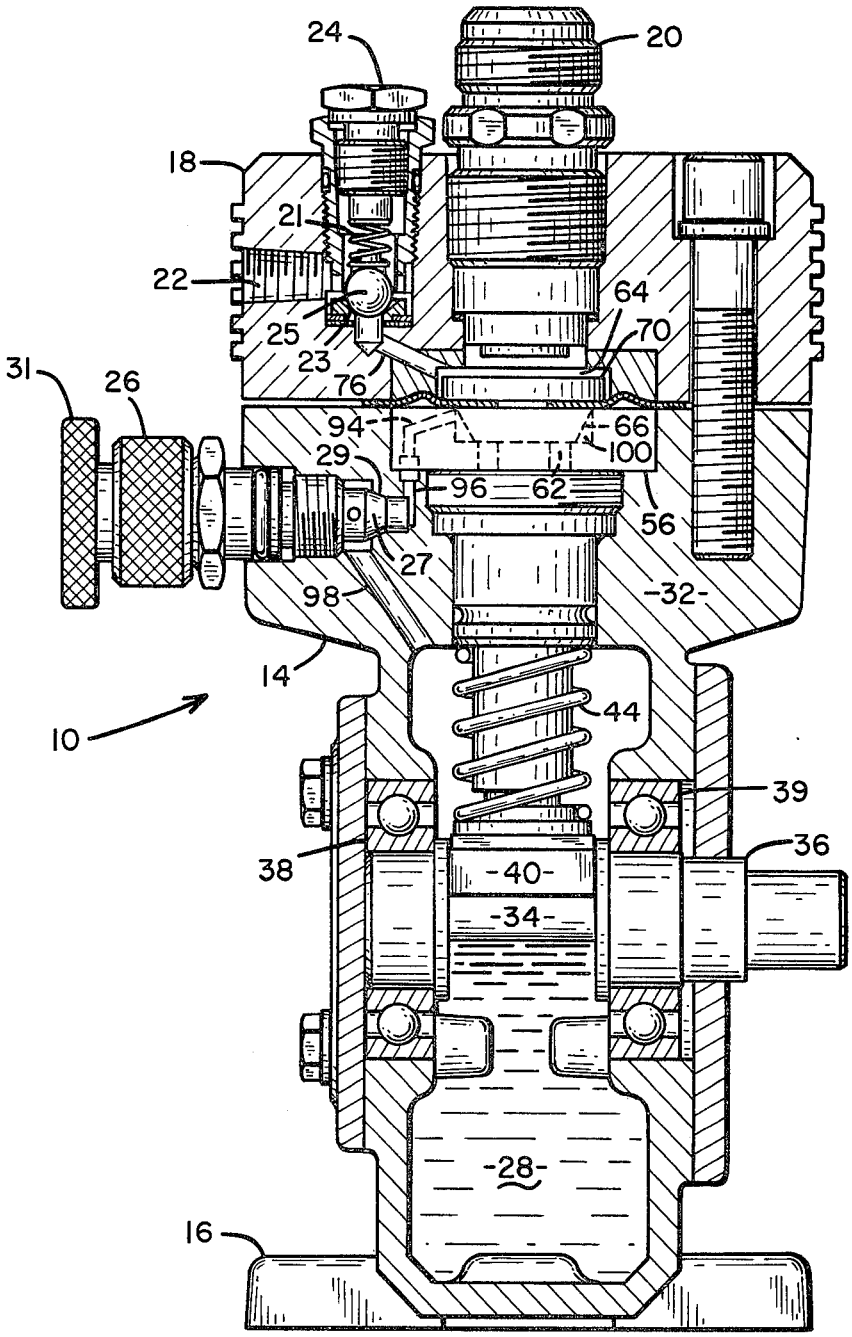
FIG. 4 is a cross-sectional view taken along the lines 4—4 of FIG. 3.

FIG. 4 shows a view in partial cross-section, taken along the lines 4—4 of FIG. 3. Outlet check valve 24 is threaded into head 18, and has a ball check 25 seated against seat 23. Ball check 25, in its normally closed position, blocks a flow communication path from chamber 64, through passage 76 to outlet port 22. Ball check 25 is urged against its seat by means of a spring 21 which is adjustably held within valve 24. Therefore, the development of a predetermined pressure in chamber 64 will cause ball check 25 to lift from its seat and thereby provide a flow communication path from chamber 64 to outlet port 22.

Pressure adjusting valve 26 is threadably attached to casing 32. A valve member 27 is seated against seat 29, and is adjustably urged in a seated position by means of a compression spring and threaded knob 31. The spring force holding valve member 27 against seat 29 may be increased or decreased by turning knob 31. A passage 94 opens through the interior bore of spool guide 56 and exits through the bottom surface of spool guide 56. A passage 96 in casting 32 is aligned with passage 94, and opens into the region in fluid flow relationship with valve member 27. A passage 98 communicates between oil reservoir 28 and valve member 27. Knob 31 may be preset to cause valve member 27 to lift from its seat upon predetermined pressures being sensed in oil chamber 100, which includes the volume confined between tapered shoulder 66 and the inside bore of spool guide 56. These pressures are also developed in passages 94 and 96, and act against the exposed surface area of valve member 27 in opposition to the spring force holding valve member 27 against its seat 29. When the forces against valve member 27 developed by the pressure in the connecting passage exceeds the forces of the compression spring holding valve member 27 against seat 29, valve member 27 is caused to lift from the seat and thereby provide oil flow communication from oil chamber 100 through the respective passages, including passage 98, back to oil reservoir 28. In this manner, oil pressure which exceeds a preset maximum is relieved back to the oil reservoir.

Figure 5:
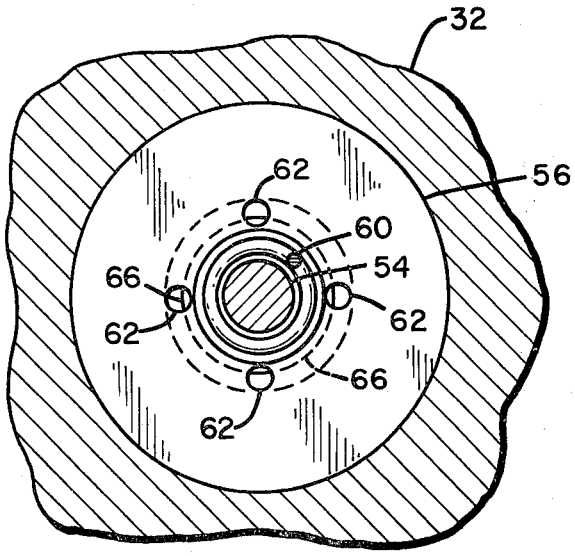
FIG. 5 is a view taken along the lines 5—5 of FIG. 2.

FIG. 5 shows a view taken along the lines 5—5 of FIG. 2, wherein spool guide 56 and its related parts are shown. Four holes 62 through spool guide 56 provide oil flow communication in oil chamber 100. The holes expose the surface of tapered shoulder 66 to the oil pressures developed throughout oil chamber 100, thereby providing a net upward force against spool 54 as a result of pressures developed within oil chamber 100.

Figure 6:
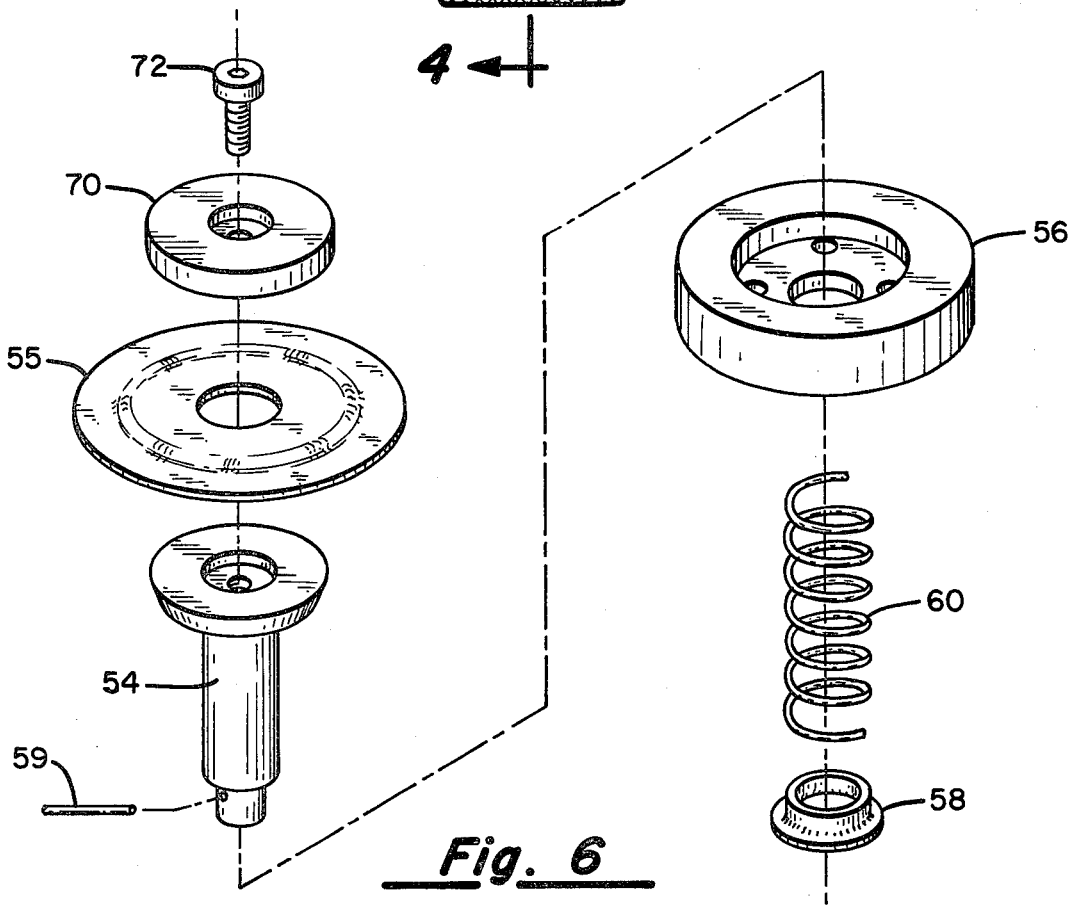
FIG. 6 is an exploded view of several parts of the invention.

FIG. 6 shows an exploded view of several parts of the invention, illustrating the assembly of these parts. Threaded fastener 72 passes through spool head 70, diaphragm 55, and threadably attaches to spool 54. Spool 54 is inserted through spool guide 56, and compression spring 60 and collar 58 are fitted over the lower stem of spool 54, and are held in place by means of pin 59. This entire assembly may be removed from oil chamber 100 whenever head 18 is disassembled from casting 32.

In operation, oil reservoir 28 is filled with oil to near the level of oil fill opening 30, and the inlet, outlet and bypass ports of the pump are connected to respective hoses for pumping. The pump may be primed by opening bypass valve 80 to relieve outlet pressure and thereby permit liquid to be pumped to be drawn into the pumping chamber during the suction strokes of spool 54. After the pump has been primed bypass valve 80 is closed and the pump is ready for operation. The mechanical reciprocation of piston 42 within sleeve 41 causes oil pressure fluctuations in oil chamber 100. During each upward stroke of piston 42 the pressure build-up in oil chamber 100 causes spool 54 to raise from its seat against spool guide 56, thereby moving spool head 70 upwardly in pumping chamber 64. Diaphragm 55 follows this movement, as it is clamped between spool head 70 and spool 54. During the downward reciprocation stroke of piston 42 an oil suction pressure develops in chamber 100, drawing spool and its connected components downwardly. This creates a suction stroke in pumping chamber 64 and draws liquid into the chamber. As the reciprocation continues, liquid is pumped from chamber 64 through outlet check valve 24 during compression strokes of piston 42, and is drawn into chamber 64 via inlet port 20 during suction strokes of piston 42.

Pressure adjusting valve 26 may be set to relieve hydraulic oil pressure at any predetermined setting. Once valve 26 is set to a preset position the continued reciprocation of piston 42 will cause continued reciprocation of the pumping action in pumping chamber 64 until a predetermined outlet pressure is developed. At that point, the pressure in oil chamber 100 will reach a level sufficient to open valve member 27 and permit oil flow through passage 94, 96 and 98 back to the oil reservoir 28. This bypass will continue until either pressure adjusting valve 26 is set to a different position or until the output pressure becomes relieved, thereby lowering the pressure in oil chamber 100.

A second outlet pressure relief valve is found in valve 80, which may be adjusted to relieve the pressure in pumping chamber 64 via bypass port 75.

Oil for replenishing chamber 100 is provided through tube 48, passage 47 and passages 51, 52. During each suction stroke of piston 42 a negative pressure develops over the foregoing fluid path to draw oil from reservoir 28 into the chamber 100, whenever the top edge of piston 42 moves to the bottom of its stroke, thereby opening passages 51, 52 to the interior of sleeve 41 and chamber 100. The negative pressure developed during the suction stroke of piston 42 causes an incremental amount of oil flow through tube 48, passages 47, 50, 51, 52 to provide this flow of replenishing oil.

The volumetric displacement of piston 42 is substantially equal to the volumetric displacement of spool valve 54 and spool head 70 during each reciprocation of pump 10. In the preferred embodiment, the stroke of piston 42 is approximately 10 mm, and the stroke of spool head 70 is approximately 2 mm. Since the stroke ratio between these members is approximately 5:1, their equivalent cross section areas are approximately in the ratio 1:5, thereby yielding substantially equal volumetric displacements during each cycle of the pump. In the preferred embodiment the volumetric displacement during each stroke of the pump is approximately 2,000 ($mm^3$). The cycle speed of the pump is about 1750 RPM, thereby yielding a theoretical pumping rate in the range of one gallon per minute. The preferred embodiment operates at output pressures up to 3,000 psi, which may be selectively adjusted by means of valve 26. Pumping pressure and rate are somewhat dependent upon the viscosity of the material being pumped, for example, in the preferred embodiment latex paint has been pumped at a pressure of 2,000 psi and at a pumping rate of 0.5 gallons per minute. The diaphragm membrane may be constructed from resilient material such as nylon or other plastic, or compounds made from rubber.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A hydraulic pumping apparatus for pumping liquids through a pumping chamber in response to pressure fluctuations in an oil chamber, comprising (a) a pump casing including an oil reservoir and a mechanically reciprocable piston axially movable in a cylinder in liquid communication with said oil reservoir, said cylinder forming a part of an oil chamber for containment of oil;

(b) a spool suspended in said oil chamber, and substantially completely occupying an area in said oil chamber transverse to said axially movable piston reciprocation;

(c) a diaphragm membrane attached to said spool and separating said oil chamber from said pumping chamber;

(d) inlet and outlet check valves in flow communication with said pumping chamber; whereby mechanical reciprocation of said piston causes hydraulic pressure reciprocation of said spool and diaphragm and pumping of liquids through said pumping chamber inlet and outlet check valves; and (e) a guide member encircling said spool, said guide member having a plurality of passages therethrough.

2. The apparatus of claim 1, further comprising adjustable pressure relief means in flow communication between said oil chamber and said oil reservoir, for selecting a maximum oil chamber pressure.

3. The apparatus of claim 2, further comprising a passage between said oil reservoir and said oil chamber, said passage opening into said oil chamber through said cylinder at a point near the stroke end of said mechanically reciprocable piston.

4. The apparatus of claim 3, further comprising a pressure bypass valve in flow communicatiin with said pumping chamber.

5. A liquid pump for high pressure delivery of liquids through a pumping chamber in said pump having inlet and outlet check valves for admitting liquid into said pumping chamber during a suction stroke of a piston in an oil chamber and forcing liquid from said pumping chamber during a compression stroke of said piston, and having oil chamber pressure relief valves to disable the effects of said piston stroke under predetermined pressure conditions, comprising:

(a) a casing enclosing said pump and having an oil reservoir therein;

(b) a sleeve in said casing, said sleeve at least partially defining said oil chamber;

(c) a mechanically reciprocable tubular piston in said sleeve, said piston having a closed distal end defining one end of said oil chamber;

(d) a diaphragm membrane separating said pumping chamber from said oil chamber;

(e) a spool fixedly attached to said diaphragm, said spool having an enlarged first end on the oil chamber side of said diaphragm occupying substantially the entire area of contact between said diaphragm and said oil chamber, and said spool having a second end of reduced size projecting into said oil chamber;

(f) a spool guide affixed in an oil chamber, having an opening therethrough sized slightly larger than said spool second end, said spool guide opening receiving said spool second end, and said spool guide having a plurality of further openings therethrough; and (g) biasing means for urging said spool to a predetermined rest position.

6. The apparatus of claim 5, wherein said biasing means further comprises a spring engaged between said spool and said spool guide.

7. The apparatus of claim 6, wherein said spool first end further comprises a tapered reduction in diameter over a predetermined length.

8. The apparatus of claim 6, further comprising a diaphragm clamping member threadably attached to said spool first end, said diaphragm membrane being clamped between said spool first end and said diaphragm clamping member.

9. The apparatus of claim 8, wherein said diaphragm clamping member is sized to occupy slightly less area than the cross-sectional area of said pumping chamber.

* * * * *